US005745861A

United States Patent [19]

Bell et al.

[11] Patent Number: 5,745,861

[45] Date of Patent: Apr. 28, 1998

[54] METHOD FOR TREATING MIXED RADIOACTIVE WASTE

[75] Inventors: Jimmy T. Bell, Kingston; James W. Snider, Oak Ridge, both of Tenn.

[73] Assignee: Molten Metal Technology, Inc., Waltham, Mass.

[21] Appl. No.: 613,924

[22] Filed: Mar. 11, 1996

[51] Int. Cl.[6] ..... G21F 9/00

[52] U.S. Cl. ..... 588/1; 588/201; 588/20; 210/682; 210/688; 423/DIG. 12

[58] Field of Search ..... 210/682, 688; 588/201, 1, 20; 423/210.5, DIG. 12, 6, 7

[56] References Cited

U.S. PATENT DOCUMENTS

| | | | |
|---|---|---|---|
| 4,574,714 | 3/1986 | Bach et al. | 110/346 |
| 4,602,574 | 7/1986 | Bach et al. | 110/346 |
| 4,980,093 | 12/1990 | Ohtsuka et al. | 588/1 |
| 4,983,302 | 1/1991 | Balint et al. | 210/638 |
| 5,191,154 | 3/1993 | Nagel | 588/201 |
| 5,202,100 | 4/1993 | Nagel et al. | 423/5 |
| 5,324,341 | 6/1994 | Nagel et al. | 75/503 |
| 5,453,562 | 9/1995 | Swanstrom et al. | 588/1 |
| 5,489,734 | 2/1996 | Nagel et al. | 588/1 |

*Primary Examiner*—Ngoclan Mai

*Attorney, Agent, or Firm*—Hamilton, Brook, Smith & Reynolds, P.C.

[57] ABSTRACT

Mixed radioactive wastes, such as those that include a radioactive component and a dissolved salt component, are treated by directing the waste through at least one ion-exchange medium that binds at least a portion of the radioactive component. A liquid discharge stream from which the radioactive component has been separated, and which includes the dissolved salt component, is directed into a molten bath that causes at least a portion of at least one dissolved salt component of the liquid discharge stream to be reductively vaporized and thereby form at least one vaporized product. A gaseous discharge stream is generated by the molten bath that includes at least one vaporized product. In one specific embodiment, the mixed radioactive waste includes radioactive cesium as the radioactive component and sodium nitrate as the dissolved salt component.

53 Claims, 3 Drawing Sheets

METHOD FOR TREATING MIXED RADIOACTIVE WASTE

BACKGROUND OF THE INVENTION

Mixed radioactive wastes have accumulated over the past several decades at numerous storage sites across the United States. Commonly referred to by the Department of Energy (DOE) as high level and transuranic wastes (HL/TRU), or tank wastes, because they are generally liquids or mixtures of liquids and particulates, the current inventory of these materials is estimated to be about 245,000 cubic meters.

The tank wastes that have accumulated has caused concern by public regulators and other stake holders that containment of materials in their present form will be difficult to ensure. Further, the enormous volume of HL/TRU that now exists has also been the subject of increasing sensitivity. However, known methods of treatment of these wastes is exorbitantly expensive. Also, such methods typically magnify one aspect of the problem by greatly increasing the volume of the waste in an effort to reduce emission of radioactivity or to create a non-leachable end-product.

One attempt to treat a liquid, or supernate, portion of tank wastes includes combination of the liquid with a solid additive, or grout, that will contain the liquid. This method, however, greatly adds to the volume of material requiring long-term storage. In addition, typically only a portion of the tank waste, generally the liquid portion, can be treated in this matter. Sediment, or sludge, which can constitute a significant fraction of the waste, must be treated by some other method.

A sludge component of tank wastes generally includes metal components, such as aluminum, calcium, potassium, sodium and silicon, in the form, for example, of hydroxides, oxides, phosphates, sulfates, nitrates and complex mineral species. One attempt to treat the sludge component of tank wastes has been to calcine the sludge and thereby form prills, or pellets, that can be stored. However, sodium nitrate can comprise more than 50% of the non-water fraction of many tank wastes. High levels of sodium can make the sludge component of tank wastes unsuitable for calcining.

Therefore, a need exists for a method and apparatus for treating radioactive wastes that significantly reduce or overcome the above-mentioned problems.

SUMMARY OF THE INVENTION

The present invention is directed to a method and apparatus for treating a mixed radioactive waste that includes a radioactive component and a dissolved salt component.

The method includes directing the waste through at least one ion-exchange medium that binds at least a portion of the radioactive component, thereby forming a liquid discharge stream that includes the dissolved salt component. The liquid discharge stream is directed into a molten bath that causes at least a portion of at least one dissolved salt component of the liquid discharge stream to be reductively vaporized and thereby form a gaseous discharge stream that includes at least one vaporized product.

The apparatus includes means for ion exchange that binds at least a portion of a radioactive component of a mixed radioactive waste conducted across the means for ion exchange. A vessel for containing a molten bath is connected to the means for ion exchange at an inlet of the vessel, whereby a liquid discharge stream that is formed in the means for ion exchange and that includes a dissolved salt component, can be directed from the means for ion exchange into the molten bath within the vessel. The vessel also includes an outlet, whereby a gaseous discharge stream formed by reductive vaporization in the molten bath of at least a portion of at least one dissolved salt component of the liquid discharge stream, is discharged from the vessel.

This invention has many advantages. For example, both the supernate and sludge components of mixed radioactive wastes, such as tank wastes, can be treated by the method and apparatus of the invention. Also, radioactive components can be selectively removed from the bulk of supernate by ion exchange. The supernate can subsequently be treated to convert other hazardous or bulky components, such as dissolved salts, to useful industrial raw materials in a molten bath without extensive shielding of the vessel containing the bath. Where the recyclable product is collected, they can be formed in the bath and collected in external process vessels, such as scrubbing columns, etc. Further, the sludge component of tank wastes can be directed into a molten bath to destroy salts and to reduce metals in the sludge to their respective primary states. Treatment of both the supernate and the sludge in molten baths greatly reduces the volume of materials ultimately requiring permanent disposal.

DETAILED DESCRIPTION OF THE INVENTION

The features and other details of the method and apparatus of the invention will now be more particularly described with reference to the accompanying figures and pointed out in the claims. The same number in different figures represents the same item. It will be understood that particular embodiments of the invention are shown by way of illustration and not as limitations of the invention. The principle functions of this invention can be employed in various embodiments without departing from the scope of the invention.

The present invention generally relates to a method and apparatus for treating a mixed radioactive waste that includes a radioactive component and a dissolved salt component. Processes for decomposing waste in molten metal baths are disclosed in U.S. Pat. Nos. 4,574,714, 4,602,574 and 5,177,304, the teachings of which are hereby incorporated by reference in their entirety. Methods for generally treating radioactive compositions are taught in U.S. Pat. No. 5,202,100 and U.S. Ser. No. 08/046,016, by Nagel et al., the teachings of both of which are incorporated herein by reference in their entirety.

Figure 1:
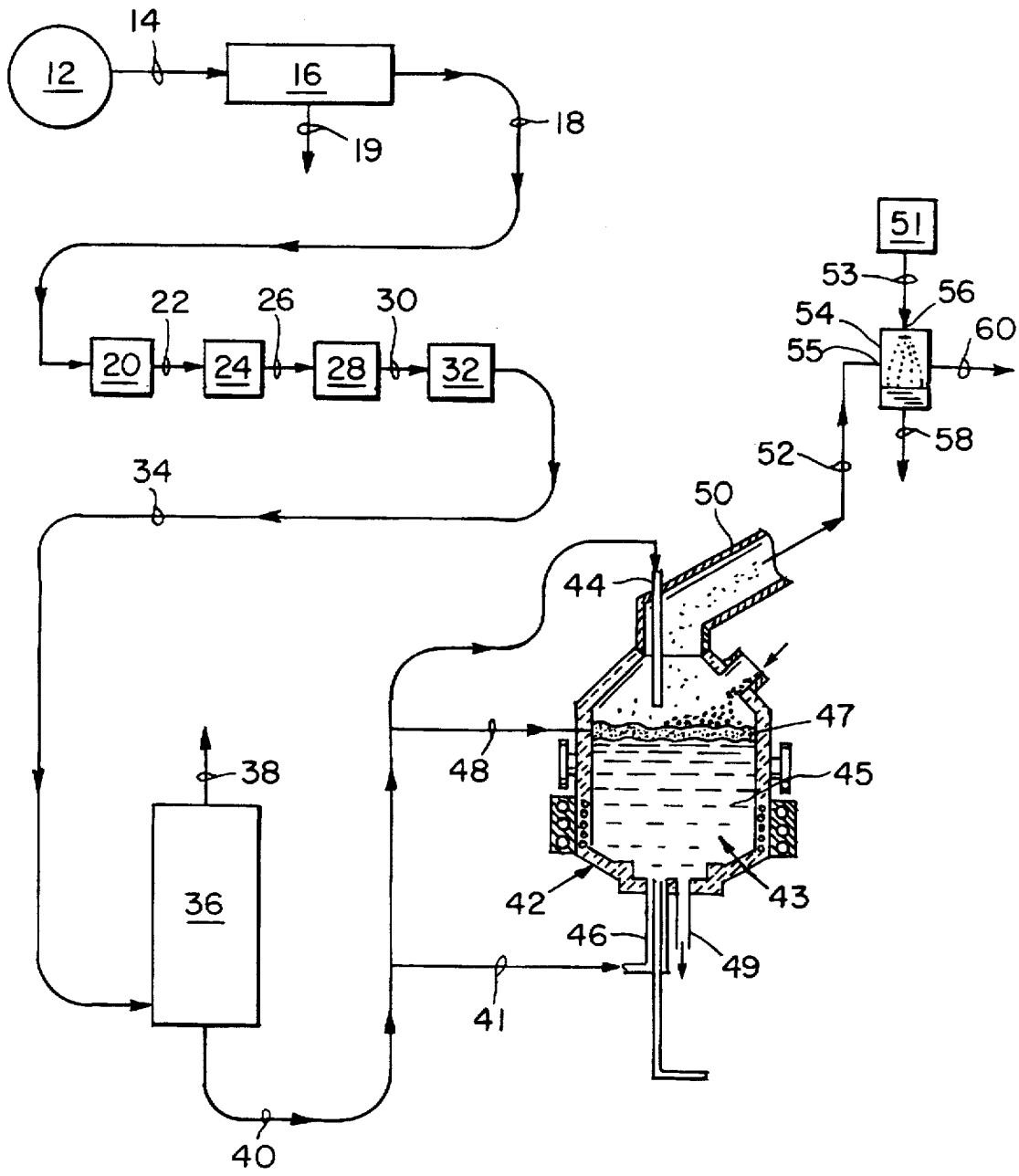
FIG. 1 is a schematic representation of one embodiment of the invention, wherein a mixed radioactive waste is filtered and a resulting supernate portion of the waste is treated according to the method of the invention.

In one embodiment of the invention, represented by the schematic drawing of FIG. 1, a mixed radioactive waste is directed from a mixed radioactive waste source 12 through line 14 to filter 16. A mixed "radioactive waste", as that term is defined herein, includes a radioactive component and a dissolved salt component. Examples of suitable mixed radioactive wastes for treatment by the method of the invention include waste that include radioactive isotopes in a variety of physical forms. Examples of radioactive contaminants includes cesium, strontium, technetium, plutonium, etc. The radioactive components can be dissolved in a liquid portion or can be a component of a solid phase of the waste. Other radioactive constituents can include cobalt, transuranic elements, radioactive carbon, etc. The radioactivity of suitable mixed radioactive wastes is typically greater than about 400 MCi. Other components of suitable mixed radioactive wastes can include metals, such as lead, cadmium, mercury, arsenic, aluminum, calcium, potassium, sodium, silicon, etc., both in their primary metal state and in other chemical states, such as hydroxides, oxides, phosphates, sulfates, nitrates, nitrites, carbonates, and complex mineral species. Mixed radioactive wastes that are suitable for treatment by the method of the invention include at least one dissolved salt component. Examples of dissolved salt components include salts of the metals previously mentioned. Among other various components that can be included in the mixed radioactive wastes are cyanide and halogens. Components of particularly suitable mixed radioactive wastes for treatment by the method of the invention include cesium as a radioactive component and sodium nitrate as a dissolved salt component.

Filtration unit 16 is suitable for separating the mixed radioactive wastes into a supernate portion and a sludge portion. Examples of suitable filtration units include sedimentation vessels, cross-flow filters, precoat filters, etc. Mixed radioactive waste directed to filtration unit 16 is separated into a supernate portion and a sludge portion. The supernate portion includes a radioactive component and a dissolved salt component. The radioactive component can be dissolved in the supernate. Examples of radioactive components of the supernate include cesium, strontium, technetium, etc. Examples of dissolved salt components include sodium, potassium, cesium, hydroxides, nitrates, chlorides, etc., and organic salts of these metals. An example of a specific dissolved salt is sodium nitrate.

Supernate is directed from filtration unit 16 through line 18 to ion exchange unit 20. Ion exchange unit 20 includes an ion exchange medium that can bind at least a portion of a radioactive component of the supernate. An example of a suitable ion exchange medium is an ion exchange medium that binds a radioactive cesium component of the supernate. Examples of specific ion exchange media that are suitable for binding radioactive cesium of the supernate are: a suitable resorcinol/formaldehyde ion exchange resin; crystalline silicotitanates; granular potassium cobalt hexacynoferrate (II); hydrous titanium oxide/potassium cobalt hexacyanoferrate (II) composites; titanium monohydrogen phosphate/sodium cobalt hexacyanoferrate (II) composites; Duolite™ (Rohm and Hass); etc. Preferably, the ion exchange medium is a resorcinol/formaldehyde ion exchange resin product by Boulder Scientific Company (Product No. BSC 187). Sludge can be directed from filtration unit 16 through line 19.

Liquid discharged from ion exchange unit 20 is directed through line 22 to ion exchange unit 24. Ion exchange unit 24 includes an ion exchange medium that is suitable for binding radioactive strontium, such as a suitable resorcinol/formaldehyde ion-exchange resin. Strontium accumulates in ion exchange unit 24 and can periodically be removed from ion exchange unit 24 for appropriate disposal. An example of a method for disposing of accumulating strontium is combination of the strontium with a suitable cement to thereby fix the strontium. An example of a suitable cement is a hydraulic cement, such as Portland Cement cementatious grout. The resulting fixed strontium is then in condition for long-term storage.

Liquid discharged from ion exchange unit 24 is directed through line 26 to electrochemical ion exchange unit 28. Electrochemical ion exchange unit 28 includes an ion exchange medium that is suitable for binding a radioactive metal. In one embodiment, electrochemical ion exchange unit 28 is suitable for binding residual radioactive cesium, to thereby separate the radioactive cesium from the liquid stream passing through electrochemical ion exchange unit 28. An example of a suitable ion exchange medium is resorcinol formaldehyde resin that is suitable for selectively binding radioactive cesium.

Electrochemical ion exchange unit 28 can be operated by applying electrical elution of an absorber matrix of the electrochemical ion exchange unit 28 at a suitable current for selectively binding a radioactive metal, such as radioactive cesium. An example of a suitable current density is a current density of about 40 $mA/cm^2$. Cesium that accumulates in ion exchange unit and electrochemical ion exchange unit 28 can periodically be removed for disposal or storage by a suitable method. For example, the cesium can be eluted from a suitable resorcinol/formaldehyde resin located between an electrode and a cathode into a flowing stream of water. The cesium can then be combined with an appropriate fixing agent, such as sulfur polymer cements or hydraulic cements, or can be converted into a stable salt and canned as a sealed source for storage or used in irradiators.

Liquid discharged from electrochemical ion exchange unit 28 through line 30 to electrodeposition unit 32. Electrodeposition unit 32 is suitable for causing electrodeposition of a radioactive component of the liquid stream conducted through electrodeposition unit 32. In one embodiment, electrodeposition unit 32 is suitable for causing electrodeposition of at least a portion of a technetium component of the liquid stream. At least a portion of a technetium component of the liquid directed through electrodeposition unit 32 is selectively removed from the liquid by electrodeposition within electrodeposition unit 32.

Technetium selectively removed from the liquid accumulates within electrodeposition unit 32. The technetium can be reduced to the elemental state and captured on a calomel or platinum electrode at an electromotive force of between about 1 volt and 2.5 volts. At appropriate intervals, technetium that has accumulated within electrodeposition unit 32 can be removed for disposal by a suitable method. An example of a suitable method of disposing of accumulated technetium is combination of the technetium with a suitable cement, such as a sulfur polymer cement, that can be employed to fix the technetium or fabricated into a sealed source for storage. The resulting fixed technetium can then be stored.

Alternatively, any or all of the radioactive metals that accumulate in the ion exchange units 20,24, electrochemical ion exchange unit 28, or electrodeposition unit 32, can be disposed of by directing them into a vessel that contains a molten bath that is suitable for treating ion exchange mediums that contain radioactive components. Examples of suitable vessels and methods of treating feeds that include radioactive components are disclosed in U.S. Pat. No. 5,202,100, U.S. Ser. No. 08/046,016, and U.S. Ser. No. 08/486, 377, the teachings of all of which are incorporated herein by reference in their entirety.

A liquid discharge stream is discharged from electrodeposition unit 32 through line 34 to evaporation unit 36. Evaporation unit 36 is suitable for vaporizing at least a portion of a vaporizable component of the liquid discharge stream. An example of a vaporizable component of the liquid discharge stream is water. An example of a suitable evaporation unit is a wiped-film evaporator. At least a portion of a vaporizable component, such as water, of the liquid discharge stream is vaporized in evaporation unit 36. Vapor formed in evaporation unit 36 is discharged from evaporation unit 36 through vapor outlet 38 for suitable treatment and subsequent release to the environment. An example of suitable treatment of vapor discharge from evaporation unit 36 is condensation followed by filtration, activated carbon absorption, etc.

The remaining portion of the liquid discharge stream in evaporation unit 36 is directed through conduit 40 to vessel 42. Molten bath 43 is contained in vessel 42 and is suitable for causing at least a portion of at least one salt component of the feed stream directed into molten bath 43 to dissociate and form at least one dissociation product, whereby a gaseous discharge stream is formed that includes at least one dissociation product. In one embodiment, molten bath 43 is a molten metal bath. Examples of suitable molten baths and methods for operating systems that employ suitable molten baths are taught in U.S. Pat. No. 4,602,574, U.S. Pat. No. 4,574,714, U.S. Pat. No. 5,177,304, U.S. Pat. No. 5,298,233, U.S. Pat. No. 5,191,154, U.S. Pat. No. 5,358,697, U.S. Pat. No. 5,354,940, U.S. Pat. No. 5,324,341, U.S. Pat. No. 5,358,549, and U.S. Pat. No. 5,322,547, the teachings of all of which are incorporated herein by reference in their entirety. The teachings of suitable molten baths and systems for treating radioactive compositions by employing such baths are taught in U.S. Pat. No. 5,202,100, U.S. Ser. No. 08/046,016, by Nagel et al., and U.S. Ser. No. 08/486,377, by Loewen et al., the teachings of which are incorporated by reference in their entirety. In one embodiment, the molten bath 43 can include a lower, molten metal layer 45, and an upper, vitreous layer 47.

Feed directed into vessel 42 can be top-loaded onto molten bath 43 through inlet 44. Alternatively, the feed can be directed into molten bath 43 by submerged injection through line 41 and tuyere 46. In still another embodiment, the feed can be directed into a vitreous layer of molten bath 43 by submerged injection through side-injection port 48. Examples of methods and apparatus for submerged injection of feed into molten bath 43 through a tuyere is disclosed in U.S. Pat. Nos. 5,443,572 and 5,436,210, the teachings of both of which are incorporated herein by reference in their entirety. An example of a suitable method and apparatus for top-charging the feed into molten bath 43 is disclosed in U.S. Ser. No. 08/042,619, by Robert et al. the teachings of which are incorporated herein by reference in their entirety. Molten bath 43 can be discharged from vessel 42 through outlet 49.

Molten bath 43 in vessel 42 causes at least a portion of at least one salt component of the feed directed into the bath to be reductively vaporized and thereby form a gaseous discharge stream that includes at least one vaporized product. "Reductive vaporization," as that term is employed herein, means vaporization of at least one component of a salt directed into the bath that is chemically reduced prior to or during vaporization of that component. An example of a suitable molten bath is a molten iron bath maintained at a temperature of between about 1,400° C. and about 1,700° C. An example of a vaporized product is vaporized sodium that is formed by reductive vaporization of sodium nitrate in a molten iron bath. Reductive vaporization of sodium nitrate in a molten iron bath causes formation of a gaseous discharge stream that includes sodium as a component of the gaseous discharge stream. Vaporized products that can be components of the gaseous discharge stream formed in vessel 42 include, for example, cesium, mercury, lead, potassium, etc.

Gas generated by direction of feed into molten bath 43 is discharged from vessel 42 as a gaseous discharge stream through gaseous outlet 50 and is conducted through line 52 to scrubber 54 at inlet 55. In one embodiment, the gaseous discharge stream is scrubbed in scrubber 54 with water directed from water source 51 through line 53 into scrubber 54 through inlet 56, whereby a sodium component of the gaseous discharge stream reacts with the water to form sodium hydroxide that is separated from the gaseous discharge stream. The gaseous discharge stream is then discharged from scrubber unit 54 through gas outlet 58. The scrubber liquid is discharged from scrubber through outlet 60.

Figure 2:
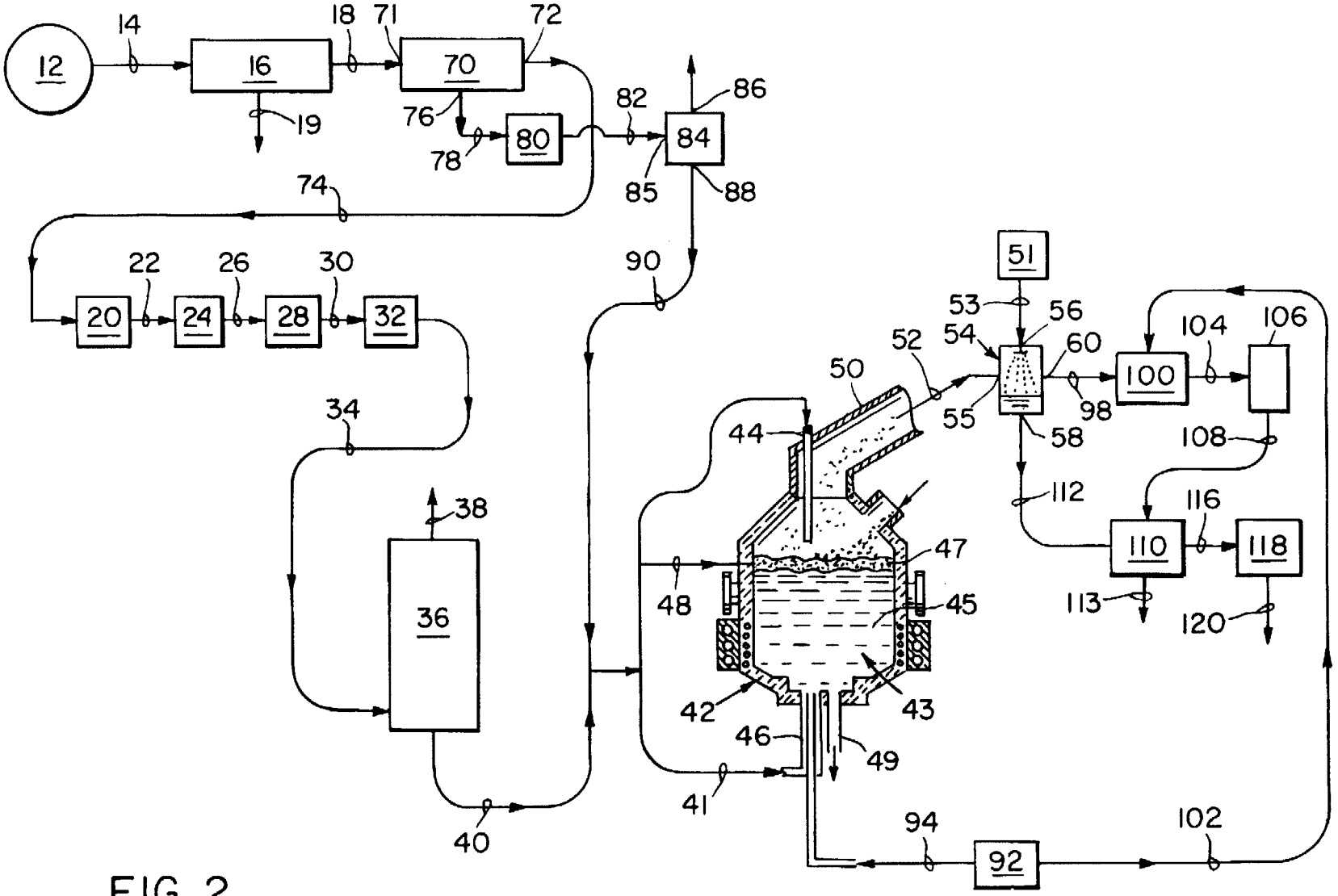
FIG. 2 is a schematic representation of another embodiment of the claimed method, wherein a mixed radioactive waste that contains a radioactive carbon component is filtered, and wherein a resulting supernate component is exposed to phase separation for subsequent distinct treatment of the radioactive carbon component.

As can be seen in FIG. 2, in another embodiment of the invention, organic materials can be separated from supernate generated during filtration of the mixed radioactive tank wastes in filtration unit 16. The organic materials can be separated from the supernate by directing the supernate from filtration unit 16 through line 18 to phase separation unit 70 at inlet 71. Examples of suitable methods of phase separation in phase separation unit 70 include sedimentation and filtration.

Supernate is directed from phase separation unit 70 through supernate outlet 72 and line 74 to ion-exchange unit 20. Organic solids that accumulate within phase separation unit 70 can be directed through solids outlet 76 and line 78 to holding vessel 80. The organic solids can then be directed from holding vessel 80 through line 82 to evaporator 84 at inlet 85. An example of a suitable evaporator is a wiped-film evaporator. Gas, such as water vapor vaporized in evaporator 84 is discharged from evaporator 84 through gaseous outlet 86 for suitable treatment, such as scrubbing and subsequent discharge to the atmosphere. Organic solids can be discharged through solids outlet 88 and line 90 for direction into vessel 42 by top-loading, side injection or bottom injection, all of which are described above.

The organic solids directed into vessel 42 can include radioactive carbon ($C^{14}$). Alternatively, carbon or radioactive carbon can be directed into molten bath 43 in vessel 42 from some other suitable source, such as activated carbon filters and irradiated-reactor graphite-moderators. Carbon, as well as radioactive carbon, in molten bath 43 can react with available oxygen, such as oxygen formed by reductive vaporization of sodium nitrate in molten bath 43, to form carbon monoxide that is discharged from the bath as a component of the gaseous discharge stream. Alternatively, oxygen can be directed into molten bath 43 from oxygen source 92 through line 94 and tuyere 46.

Carbon monoxide is conducted as a component of the gaseous discharge stream through scrubber unit 54 and is discharged with the gaseous discharge stream from the scrubber through outlet 60 and conducted through line 98 to vessel 100. Oxygen is directed from oxygen source 92 through line 102 to vessel 100 for combination with carbon monoxide and subsequent reaction to form carbon dioxide.

The carbon dioxide and remaining components of the gaseous discharge stream are then discharged from vessel 100 through line 104 to filtration unit 106 for removal of residual entrained solids. The gaseous discharge stream and carbon dioxide are discharged from filtration unit 106 through line 108 to vessel 110 for combination with scrubber liquid discharged from scrubber unit 54 through outlet 58 and line 112 to vessel 110. The carbon dioxide and sodium hydroxide are combined in vessel 110 and react to form sodium carbonate ($Na_2CO_3$). The sodium carbonate precipitates from a scrubber fluid and is directed through outlet 113 for suitable disposal, such as fixation with a hydraulic cement such as Portland Cement cementatious grout. The carbon component of the sodium carbonate can include the radioactive carbon of organic materials separated from the mixed radioactive tank waste. Alternatively, the sodium hydroxide can be recycled within the apparatus to neutralize radioactivity-contaminated acidic wastes, resulting in the formation of useful product. Remaining components of the gaseous discharge stream then can be discharged from vessel 110 through line 116 to filtration unit 118 and subsequent release to the atmosphere through outlet 120.

Figure 3:
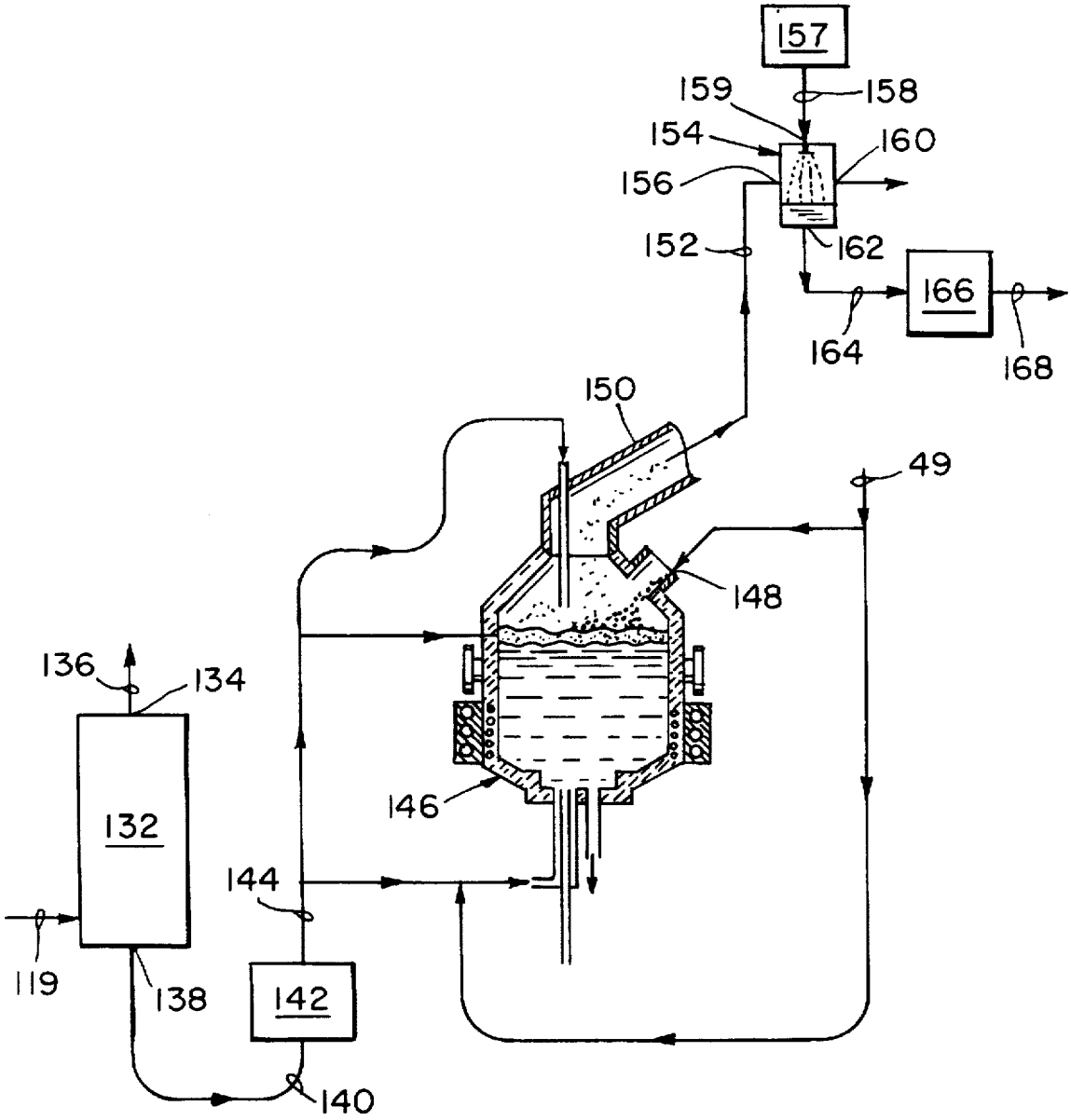
FIG. 3 is a schematic representation of another embodiment of the claimed method, wherein a sludge component resulting from filtration of a mixed radioactive waste is treated according to the method of the claimed invention.

As represented in the schematic of FIG. 3, sludge collected by filtration of mixed radioactive tank waste, as described above, is treated by directing the sludge from filtration unit 16 shown in FIGS. 1 and 2, through line 19 to drying unit 132 at inlet 133, shown in FIG. 3. At least a portion of vaporizable components of the sludge are vaporized in drying unit 132 and discharged through vapor outlet 134 of drying unit 132. Examples of suitable drying units include wiped film evaporators, belt dryers, rotary tube dryers, etc. An example of suitable conditions for vaporizing at least a portion of a vaporizable component of the sludge includes exposing the sludge to a temperature in a range of between about 80° C. and about 140° C. at an absolute pressure in a range of about ten millimeters of mercury and about two atmospheres, for a period of time in a range of between about five minutes and about forty-five minutes. Vapor discharged from drying unit 132 is conducted through outlet 134 and line 136, and then condensed for combination with supernate and subsequent treatment by ion exchange, as discussed above.

The dried sludge in drying unit 132 is then suitably treated for subsequent injection into a molten bath. An example of suitable treatment is directing the dried sludge from sludge drying unit 132 through solids outlet 138 and line 140 to grinding and screening unit 142. Grinding and screening unit converts the dried sludge to a particulate solid that can be suspended for submerged injection through line 144 into vessel 146 containing a molten bath. Suitable vessels, molten baths and methods for directing feed into the molten bath in vessel 146 are the same as those described above with regard to vessel 42. The particulate solids directed into vessel 42 can include a wide variety of materials.

Examples of metal components that can remain in vessel 42 in a molten bath, such as a molten iron bath, include chromium, cobalt, etc. Examples of components of the feed that can be captured in the vitreous phase of the molten bath include uranium dioxide ($UO_2$), plutonium dioxide ($PuO_2$), alumina ($Al_2O_3$), calcium oxide (CaO), strontium oxide (SrO), rare earth oxides such as lanthanum oxide ($La_2O_3$), etc.

Vessel 146 and the molten bath therein are suitable for containing radioactivity generated by components of particulate dried sludge directed into vessel 146. Examples of suitable methods and apparatus for treating particulate materials directed into molten baths in vessels is described in U.S. Pat. No. 5,202,100, U.S. Ser. No. 08/046,016, and U.S. Ser. No. 08/486,377, the teachings of all of which are incorporated herein by reference in their entirety.

Other feeds that can be directed into vessel 146 and the molten bath include the vitreous layer or molten metal layer of the molten bath from vessel 42, organic material, such as radioactive carbon-containing organic material separated from the supernate, other sources of carbon, including other sources of radioactive carbon, etc. In particular, molten material from vessel 42, shown in FIGS. 1 and 2, can be directed through line 49 and inlet 148 into molten bath of vessel 146, shown in FIG. 3, for further treatment of components retained within the molten material of the molten bath employed to treat the liquid discharge stream derived from the supernate.

Gas generated within vessel 146 can include, for example, vaporized metals, including sodium, cesium, mercury, lead, etc. Gas is discharged from vessel 146 through outlet 150 and conduit 152 to scrubbing unit 154 at inlet 156. In one embodiment, gas directed through scrubbing unit 154 is scrubbed with water directed from water source 157 through line 158 into scrubbing unit 154 at inlet 159. The water reacts with vaporized sodium, potassium, cesium, and lead for example, to form sodium hydroxide, potassium hydroxide, cesium oxide, and lead hydroxide, respectively. As a consequence of forming these reaction products, the pH of the resulting scrubber liquid will be relatively basic, thereby potentially causing at least a portion of other vaporized components, such as mercury and lead, to precipitate. Gas discharged from scrubbing unit 154 through outlet 160 can be filtered and released to the atmosphere. Liquid effluent discharged from scrubbing unit 154 is directed through outlet 162 and conduit 164 to filtration unit 166 for separation of precipitates, such as mercury and lead, from the liquid effluent. The liquid effluent discharged from filtration unit 166 is subsequently directed through conduit 168 and combination with the supernate for subsequent treatment by ion exchange, as described above. Dissolved components of the effluent, such as cesium hydroxide, potassium hydroxide, sodium hydroxide, lead hydroxide, lead and mercury, will be directed through the ion exchange units and conducted with the resulting liquid discharge stream into vessel 42 and molten bath 43 contained therein, shown in FIGS. 1 and 2.

Precipitants that accumulate within filtration unit 166, shown in FIG. 3, such as precipitated lead and mercury, can be treated by a suitable method. An example of a suitable method is drying of the precipitants and subsequent fixation by a suitable method. An example of a suitable method of fixing dried lead and mercury precipitants includes combination of these materials with sulfur polymer cement. The resulting fixed material is then suitable for long-term storage.

EQUIVALENTS

Those skilled in the art will recognize, or be able to ascertain using no more than routine experimentation, many equivalents of the invention described specifically herein. Such equivalents are intended to be encompassed in the scope of the following claims.

We claim:

1. A method for treating a mixed radioactive waste that includes a radioactive component and a dissolved salt component, comprising the steps of:

a) directing the waste through at least one ion-exchange medium that binds at least a portion of the radioactive component, thereby forming a liquid discharge stream that includes the dissolved salt component; and b) directing said liquid discharge stream into a molten bath that causes at least a portion of at least one dissolved salt component of the liquid discharge stream to be reductively vaporized and thereby form a gaseous discharge stream that includes at least one vaporized product.

2. The method of claim 1, wherein the waste is directed through at least two ion-exchange media to form the liquid discharge stream.

3. The method of claim 2, wherein the ion-exchange media each preferably bind a distinct radioactive component.

4. The method of claim 3, wherein the waste is directed through at least one electrochemical ion-exchange medium.

5. The method of claim 4, wherein the waste is directed through an electrochemical ion-exchange medium following direction of the waste through a chemical ion-exchange medium.

6. The method of claim 5, further including the step of evaporating at least a portion of a liquid component of the liquid discharge stream before said liquid discharge stream is directed into the molten bath.

7. The method of claim 6, further including the step of exposing the liquid discharge stream to electrodeposition, whereby at least one heavy metal component is separated from the liquid discharge stream.

8. The method of claim 7, wherein said electrodeposition causes separation of technetium from the liquid discharge stream.

9. The method of claim 1, wherein the liquid discharge stream is directed into a molten bath that includes an iron component.

10. The method of claim 1, wherein the liquid discharge stream is directed into a molten bath that includes a nickel component.

11. The method of claim 1, wherein the liquid discharge stream is directed into a molten bath that includes copper.

12. The method of claim 1, wherein an ion-exchange medium through which the radioactive waste is directed selectively binds a cesium component of the radioactive waste.

13. The method of claim 1, wherein an ion-exchange medium through which the radioactive waste is directed selectively binds a strontium component of the radioactive waste.

14. The method of claim 12, wherein selective binding of cesium includes exposure of the radioactive waste to electrochemical ion exchange.

15. The method of claim 1, further including the step of combining a dissociation product of the gaseous discharge stream with a reactant, whereby the dissociation product and the reactant react to form a reaction product.

16. The method of claim 15, wherein the dissociation product and the reactant are combined by scrubbing the gaseous discharge stream with a liquid that includes the reactant.

17. The method of claim 16, wherein the reactant includes water.

18. The method of claim 17, wherein the gaseous discharge stream includes sodium as a dissociation product, whereby reaction with said water reactant causes formation of sodium hydroxide as a reaction product that is a component of a scrubber liquid discharge stream.

19. The method of claim 15, wherein the reactant includes oxygen.

20. The method of claim 19, wherein the gaseous discharge stream includes carbon monoxide that contains carbon$^{14}$ as a dissociate product, whereby reaction with said oxygen reactant causes formation of carbon dioxide that contains said carbon$^{14}$.

21. The method of claim 20, further including the step of reacting said carbon dioxide with sodium hydroxide to thereby form sodium carbonate that includes the carbon$^{14}$.

22. The method of claim 21, further including the step of solidifying the sodium carbonate.

23. The method of claim 1, further including the step of filtering the radioactive waste to thereby form a sludge component and supernate component.

24. The method of claim 23, further including the step of settling the radioactive waste prior to directing the radioactive waste through said ion-exchange medium, whereby a supernate and a sediment are formed, said supernate being subsequently directed through said ion-exchange medium and said sediment being directed into the molten bath that causes at least one radioactive organic component of the sediment to dissociate and form radioactive carbon.

25. The method of claim 24, further including the step of directing an oxygen source into the molten bath, whereby the oxygen source reacts with the radioactive carbon to form radioactive carbon monoxide that is discharged from the molten bath as a component of a gaseous discharge stream.

26. The method of claim 25, wherein supernate discharged from the ion-exchange medium is the oxygen source that is directed into the molten bath.

27. The method of claim 26, wherein the gaseous discharge stream includes sodium, and further including the steps of:

a) combining the gaseous discharge stream with water, whereby the water reacts with the sodium to form sodium hydroxide that separates from the gaseous discharge stream;

b) combining the gaseous discharge stream with an oxygen source, whereby the oxygen source reacts with radioactive carbon monoxide in the gaseous discharge stream to form radioactive carbon dioxide; and c) combining the radioactive carbon dioxide with the sodium hydroxide, whereby the radioactive carbon dioxide reacts with the sodium hydroxide to form a radioactive sodium carbonate precipitate.

28. The method of claim 27, further including the step of solidifying the radioactive sodium carbonate.

29. The method of claim 23, further including the step of directing at least a portion of said sludge component into a molten bath.

30. The method of claim 29, further including the step of separating a vaporizable portion from the sludge component before directing said sludge component into the molten bath.

31. The method of claim 30, further including the step of combining the vaporizable portion with the supernate.

32. The method of claim 31, further including the step of directing the combined vaporizable portion and supernate through an ion-exchange medium.

33. The method of claim 30, further including the steps of converting the sludge component into a sludge particulate that can be suspended by a gas to form a suspended particulate stream.

34. The method of claim 33, further including the step of combining the sludge particulate with a gas stream to form a suspended particulate stream.

35. The method of claim 27, further including the step of directing the gaseous discharge stream, from which carbon dioxide has been removed by reaction with sodium hydroxide, into a molten bath.

36. The method of claim 35, wherein the liquid discharge stream is directed into a first molten bath and wherein the gaseous discharge stream, from which carbon dioxide has been removed by reaction with sodium hydroxide, is directed into a second molten bath.

37. The method of claim 36, further including the step of scrubbing the gaseous discharge stream, from which carbon dioxide has been removed by reaction with sodium hydroxide, to thereby form a second scrubber liquid discharge stream.

38. The method of claim 37, wherein the second scrubber liquid discharge stream is formed by scrubbing the gaseous discharge stream with water.

39. The method of claim 38, wherein the radioactive waste material causes the second scrubber liquid discharge stream to include at least one member selected from the group consisting of cesium hydroxide, sodium hydroxide, lead hydroxide, potassium hydroxide, lead and mercury.

40. The method of claim 39, further including the step of filtering the second scrubber liquid discharge stream to thereby form a filtrate that includes at least one of cesium hydroxide and sodium hydroxide and to form a residue that includes at least one of lead and mercury.

41. The method of claim 40, further including the step of combining the filtrate with the supernate.

42. The method of claim 41, further including the step of separating a vaporizable portion from the residue.

43. The method of claim 42, wherein the vaporizable portion of the residue is separated from the residuing by vaporizing said portion.

44. The method of claim 43, further including the step of fixing the residue.

45. The method of claim 44, wherein said residue is fixed by mixing the residue with a sulfur polymer cement.

46. The method of claim 36, further including the step of directing a portion of the first molten bath to the second molten bath.

47. The method of claim 36, further including the step of directing a carbon source into the second molten bath.

48. A method for treating a radioactive waste that includes a radioactive component, a metal component, and a dissolved salt component, comprising the steps of:

a) settling the radioactive waste to form a supernate layer that includes the radioactive component and the dissolved salt component, and a sludge layer that includes the heavy metal component;

b) directing the supernate layer through at least one ion-exchange medium that binds at least a portion of the radioactive component, thereby form a liquid discharge stream that includes the dissolved salt component;

c) directing said liquid discharge stream into a first molten bath, said first molten bath causing at least a portion of at least one dissolved salt component of the liquid discharge stream to dissociate and form at least one dissociation product, whereby a gaseous discharge stream is formed that includes at least one said dissociation product; and d) directing said sludge layer into a second molten bath, whereby at least a portion of the metal component vaporizes and is discharged from second molten bath.

49. The method of claim 48, further including the steps of:

a) separating a vaporizable portion from the sludge layer before directing said sludge layer into the molten bath; and b) combining the vaporizable portion with the supernate layer.

50. The method of claim 49 wherein the supernate includes a radioactive carbon component and a sodium carbonate component, whereby a gaseous discharge stream generated by the first molten bath includes a sodium component, further including the steps of:

a) directing an oxygen source into the molten bath, whereby the oxygen source reacts with a radioactive carbon component to form radioactive carbon monoxide that is discharged from the molten bath as a component of the first gaseous discharge stream;

b) combining the gaseous discharge stream with water, whereby the water reacts with the sodium to form the gaseous discharge stream; and c) combining the gaseous discharge stream with an oxygen source, whereby the oxygen source reacts with carbon monoxide in the gaseous discharge stream to form radioactive carbon dioxide.

51. The method of claim 50, further including the step of combining the radioactive carbon dioxide with the sodium hydroxide, whereby the radioactive carbon dioxide reacts with the sodium hydroxide to form a radioactive sodium carbonate precipitate.

52. The method of claim 51, further including the steps of:

a) directing the gaseous discharge stream, from which carbon dioxide has been removed by reaction with sodium hydroxide, into the second molten bath; and b) directing at least a portion of the first molten bath into the second molten bath.

53. The method of claim 51, further including the steps of:

a) scrubbing the gaseous discharge stream, from which carbon dioxide has been removed by reaction with sodium hydroxide, with water to form a second scrubber liquid discharge stream that includes at least one component of the radioactive waste, said component selected from the group consisting of cesium in the form of cesium hydroxide, sodium in the form of sodium hydroxide, lead and mercury;

b) filtering the second scrubber liquid discharge stream to thereby form a filtrate that includes at least one of cesium hydroxide and sodium hydroxide and to form a residue that includes at least one of lead and mercury;

c) combining the filtrate with the supernate; and d) fixing the residue.

* * * * *